United States Patent [19]

Mills

[11] 3,987,827

[45] Oct. 26, 1976

[54] SHINGLE REMOVING TOOL

[76] Inventor: William R. Mills, 534 W. Montgomery Ave., Rockville, Md. 20850

[22] Filed: Mar. 5, 1976

[21] Appl. No.: 664,251

[52] U.S. Cl. ..... 145/1 A; 254/25
[51] Int. Cl.[2] ..... B66F 15/00
[58] Field of Search ..... 254/25, 26; 145/1 A, 145/21; 7/8.1 B

[56] References Cited

UNITED STATES PATENTS

| | | | |
|---|---|---|---|
| 526,995 | 10/1894 | Dana | 145/1 A |
| 743,823 | 11/1903 | Bryar | 254/25 |
| 857,077 | 6/1907 | LaBreck | 254/25 |
| 2,457,231 | 12/1948 | Henderson | 254/25 |
| 3,769,644 | 11/1973 | Case | 254/26 R |

*Primary Examiner*—Al Lawrence Smith
*Assistant Examiner*—Robert C. Watson

[57] ABSTRACT

A generally Z-shape bar has on one free end portion a forwardly-facing claw and a rearwardly-facing notch. The other free end portion constitutes a handle, and the surfaces of the knee connecting the end portions constitute anvil surfaces. Arms projecting laterally from the knee engages beneath and lift up a covering shingle whereby the claw or notch can be manipulated so as to engage a nail which holds down a covered shingle.

5 Claims, 3 Drawing Figures

FIG. 1
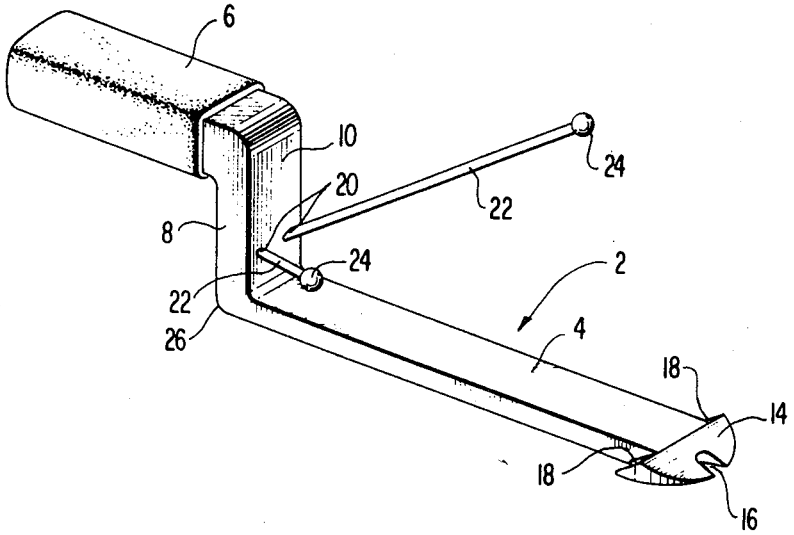
FIG. 2
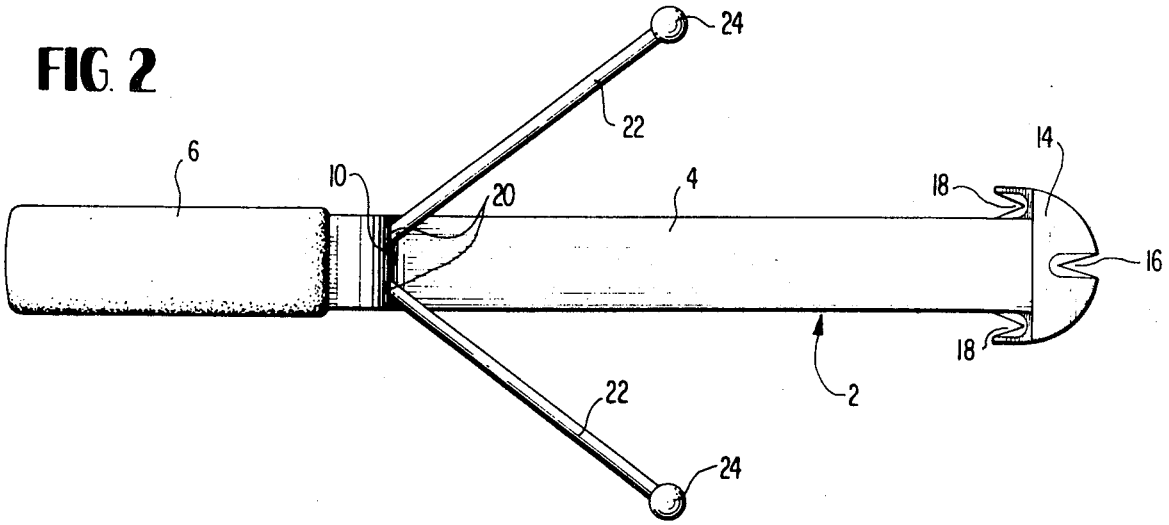
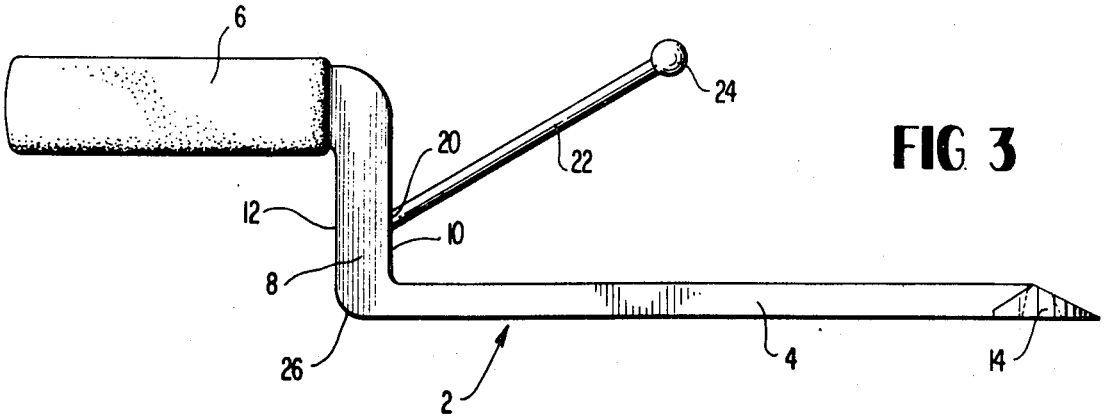
FIG. 3

SHINGLE REMOVING TOOL

FIELD OF INVENTION

Compound Tools, Crowbar.

PRIOR ART

Platt U.S. Pat. No. 1,093,946; Schoonover U.S. Pat. No. 1,405,339; Butler U.S. Pat. No. 1,515,142; Tekber U.S. Pat. No 1,642,390; Nowka et al. U.S. Pat. No. 1,647,576; and Case U.S. Pat. No. 3,769,644.

OBJECTS

Heretofore, many roofing tools have been devised for lifting shingles to be replaced. In most instances, they comprise a crowbar, in one form or another, having a claw on one free end. The free end is forced in beneath a covering shingle so as to engage and pry up a nail which holds down a shingle to be removed. Not unusually, the bar is bent or otherwise formed to provide a fulcrum between the handle and the claw so as to operate as a lever of the first class. With such tools, two problems may be encountered, the first being that it is difficult to manipulate the claw because of the covering shingle. Secondly, the nail to be removed is sometimes stubborn, and it becomes necessary to use hammer-blow force to engage the claw beneath the nail head; and it sometimes becomes desirable to engage the tool beneath the nail head from the far side, rather than the near side which is approached by the usual forwardly-facing claw.

This invention is devised to overcome the foregoing difficulties, first by providing a crow bar with arms which project laterally from the bar so as to engage beneath a covering shingle and hold it up so that the claw on the forward end of the tool can be easily manipulated to engage the nail to be lifted. Next, it is intended also to provide in the forward free end of the bar not only the usual forwardly open claw, but also a rearwardly facing notch into which the nail head can be hooked. Finally, it is intended to form the bar substantially Z-shape, with the claw and hook on one free end portion, the other free end portion constituting a handle, the knee connecting the free end portions being at a substantially right-angle with the forward free end portion and constituting an anvil which can be struck with a hammer to drive the tool in either a forward or rearward direction.

These and other objects will be apparent from the following specification and drawing, in which:

FIG. 1 is a perspective view of the tool;

FIG. 2 is a plan view; and,

FIG. 3 is a side view.

Referring now to the drawings, in which like reference numerals denote similar elements, the shingle removing tool 2 is essentially a Z-shaped crowbar having a forwardly extending free end portion 4, and a rearwardly extending free end portion 6 which constitutes a handle. The forward and rear end portions are integrally connected by a knee 8 which extends at right angles to the forward free end portion 4 and which has forwardly and rearwardly facing anvil surfaces 10 and 12. A wedge-shape head 14 on the forward free end portion 4 has a forwardly open claw 16 and rearwardly open notches 18, either of which can be engaged beneath a nail head as described hereinbelow. Projecting laterally, forwardly and upwardly from their points of connection 20 with knee 8 are a pair of arms 22 having knobs 24 on their free ends.

In operation, the wedge-shape head is forced under a shingle which covers the shingle to be removed, and pushed forwardly until the knobs 24 closely approach the free edge of the covering shingle. Thereupon, the free end portion 4 of tool 2 is rocked up about fulcrum 26, which is the outside angle at the juncture of knee 8 with the forward free end portion 4. The free edge portion of the covering shingle is thus pried upwardly so that when the tool continues its advance movement under the covering shingle, the latter is held up by knobs 24. In this condition the free end portion 4 of the tool is rocked back down about fulcrum 26 until head 14 lies flat against the shingle to be removed, whereupon claw 16 may be forced under the head of the nail to be lifted, which is accomplished by forcing handle 6 down so as to rock the head 14 upwardly. If the nail is stubborn, a hammer blow on the rearwardly facing anvil surface 12 of knee 8 may be struck so as to drive the claw under the nail head. In some instances, where this first nail-lifting operation is not successful, the free end portion 4 may be manipulated so as to hook a notch 18 under the nail head, whereupon the forwardly facing anvil surface 10 of knee 8 may be struck with a hammer blow so as to hook the nail out.

The invention is not limited to the specific form or details of the device shown and described, but is intended to cover all substitutions, modifications and equivalents within the scope of the following claims:

I claim:

1. A shingle-removing tool comprising an elongate crowbar having forwardly and rearwardly-extending free end portions said crowbar having an angle providing a fulcrum intermediate said end portion whereby said crowbar operates as a lever of first class, nail-head engaging means on said forwardly-extending free end portion, and arms projecting laterally beyond each side of said crowbar, said arms having free end portions spaced outwardly beyond and above each side of said forwardly-projecting free end portion between the fulcrum and the nail-head engaging means and constituting means for engaging beneath a shingle covering the one to be removed.

2. A shingle-removing tool as claimed in claim 1, said arms having rounded knob-like elements on the free ends thereof.

3. A shingle-removing tool as claimed in claim 1, said shingle-engaging means comprising a forwardly open claw and a rearwardly open notch, said crowbar being substantially Z-shape and including a knee portion connecting said free end portions, said knee portion having forwardly and rearwardly facing anvil surfaces disposed at substantially right angles to the direction of extent of said forwardly extending portion.

4. The combination claimed in claim 3, wherein said arms extend outwardly from said knee portion.

5. The combination claimed in claim 4, wherein the connection between the forwardly extending portion and the knee portion forms an outside angle which provides the fulcrum.

* * * * *